United States Patent [19]

Blanton et al.

[11] Patent Number: 4,947,650

[45] Date of Patent: Aug. 14, 1990

[54] METHOD AND APPARATUS FOR LIQUID CRYOGEN PRESSURIZATION OF CONTAINERS OF PARTICULATES

[75] Inventors: Russell W. Blanton, Acton; J. Eric Taylor, Topsfield; Thornton Stearns, Winchester, all of Mass.

[73] Assignee: Vacuum Barrier Corporation, Woburn, Mass.

[21] Appl. No.: 404,655

[22] Filed: Sep. 8, 1988

[51] Int. Cl.[5] ..... F17C 7/02

[52] U.S. Cl. ..... 62/50.1; 53/127; 53/432; 53/440; 53/510; 141/63; 141/82

[58] Field of Search ..... 62/50.1; 53/127, 431, 53/432, 440, 510; 141/63, 64, 82

[56] References Cited

U.S. PATENT DOCUMENTS

| | | | |
|---|---|---|---|
| 2,729,381 | 1/1956 | Wiser | 141/64 |
| 2,888,789 | 6/1959 | Mojonnier | 141/82 |
| 3,224,158 | 12/1965 | Baumann | 53/432 |
| 4,409,252 | 10/1983 | Buschkens et al. | 53/432 |
| 4,489,767 | 12/1984 | Yamada | 141/48 |
| 4,499,931 | 2/1985 | Urban | 141/63 |
| 4,546,609 | 10/1985 | Roullet | 62/49 |
| 4,602,473 | 7/1986 | Hayashi et al. | 53/432 |
| 4,662,154 | 5/1987 | Hayward | 53/431 |
| 4,703,609 | 11/1987 | Yoshida et al. | 53/432 |
| 4,715,187 | 12/1987 | Stearns | 62/50.1 |
| 4,832,968 | 5/1989 | Forage et al. | 53/127 |
| 4,869,047 | 9/1989 | Nishiguchi et al. | 141/64 |

FOREIGN PATENT DOCUMENTS

| | | |
|---|---|---|
| 2091228 | 12/1980 | United Kingdom . |
| 2089191 | 6/1981 | United Kingdom . |

*Primary Examiner*—Ronald C. Capossela

[57] ABSTRACT

Liquid cryogen is added to a container of particulate material (e.g. powder, flakes or granules) immediately before the container is capped as part of a process for pressurizing the container. A liquid cryogen retainer is positioned within the unsealed container above the particulate material, and the flow of liquid cryogen is directed to the retainer to substantially prevent eruption from the container of the particulate material, which may otherwise result when the liquid nitrogen penetrates the particulate material and causes the particulate material to erupt, with an unacceptable loss of the particulate material and of the liquid cryogen.

5 Claims, 2 Drawing Sheets

METHOD AND APPARATUS FOR LIQUID CRYOGEN PRESSURIZATION OF CONTAINERS OF PARTICULATES

BACKGROUND OF THE INVENTION

This invention generally relates to producing pressurized sealed containers. It is well known to pressurize containers of liquid, such as beverages, by adding liquid cryogen immediately before capping the containers. To control the amount of pressure generated when the liquid cryogen vaporizes, it is important to control the amount of liquid cryogen delivered to the vessels as they move along a rapid assembly line. In Stearns, U.S. Pat. No. 4,715,187, apparatus is disclosed for generating a controlled stream of liquid cryogen which provides a consistent metered amount of liquid cryogen to each container. That disclosure is hereby incorporated by reference in this application. Other disclosures relating to liquid cryogen for pressurizing containers include: GB 2,091,228; U.S. No. 4,499,931; U.S. No. 4,703,609; U.S. No. 4,546,609; GB 2,089,191; U.S. No. 4,662,154; and 4,489,767.

SUMMARY OF THE INVENTION

We have discovered that liquid cryogen, when added to a container of particulate product, behaves in different way from prior art experience involving addition of liquid cryogen to a container of liquid product. When liquid cryogen is added to a container of liquid, it tends to coalesce from surface tension, and to be surrounded by an insulating surface layer of cold dense vapor; loss of liquid nitrogen and of liquid product is thereby controlled. In contrast, we have found that, when added to particulate material, liquid cryogen tends to penetrate the particulate material and to vaporize rapidly, resulting in an eruption and an unacceptable loss of the particular material and of the liquid cryogen. Without being bound to a theory, it appears that liquid cryogen disperses into the particulate material, inhibiting coalescence of the liquid nitrogen. The resulting dispersed liquid has a relatively high surface area/volume ratio and it has efficient thermal contact with the particulate material. Rapid heat transfer, with rapid cryogen vaporization, causes a sudden increase in volume, which entrains both liquid cryogen and the particulate material in an eruption out of the open container.

One aspect of our invention features a method of producing a pressurized sealed container of particulate material in which a metered flow of a desired amount of liquid cryogen is directed into an unsealed container of the particulate material immediately before the container is sealed. A liquid cryogen retainer is positioned within the unsealed container above the particulate material, and the flow of liquid cryogen is directed toward the retainer.

In preferred embodiments of the method, the liquid cryogen retainer is a vessel which may include a lip engaging the top of the container. The vessel may extend substantially around the perimeter of the container so as to be sealed after the container is capped; in that event the vessel includes at least one vent positioned to communicate pressure from vaporized liquid nitrogen to the remainder of the container. Alternatively, the retainer is a generally flat separating member, such as a sheet whose edges are crimped to contain liquid cryogen, or a paper "cup" with pleated sides.

A second aspect of the invention generally features apparatus for producing a pressurized container of particulate material material comprising, (a) means for producing a directed metered flow of a desired amount of liquid cryogen to an unsealed container of the particulate material; and (b) a retainer adapted to be positioned within the unsealed container above particulate material, to retain liquid cryogen and to substantially prevent eruption of the particulate material that would otherwise result from penetration of liquid cryogen into the particulate material.

In preferred embodiments of the apparatus, the retainer is a vessel comprising a lip adapted to seat on the rim of the container. The vessel may be adapted to extend around the perimeter of the container so as to be sealed after the container is capped; in that event, the vessel comprises at least one vent. Alternatively, the retainer may comprise a generally flat separating member, whose edges crimped to contain liquid cryogen.

The invention is useful in general with particulate materials, e.g., solid phase substances which are fragmented into particles, such as granules, powders or flakes, to avoid, e.g., the following potentially serious consequences of eruption. First, the total volume of liquid cryogen required to yield an acceptable pressure increases substantially (e.g. 5-fold) as a result of losses from eruption. Second, control over the amount of liquid cryogen remaining at capping is reduced, risking an increased container rejection rate due to improper pressurization. Third, control over the amount of particulate product remaining in the sealed container is reduced, increasing the rejection rate for improper product loading. Fourth, spillage of product on the assembly line can create unacceptable health, mechanical and maintenance problems. Fifth, spillage of liquid nitrogen (particularly increased spillage between containers due to higher liquid nitrogen flow rates that are required due to the relatively low amount of liquid remaining within the container at the instant it is capped) causes frost, condensation, fog, and a generally disorderly manufacturing environment, as well as increased cost. The above problems are exacerbated in higher-speed lines because the time available to deliver the desired liquid cryogen volume to a given container is reduced, and the resulting higher flow rate is more likely to penetrate the particulates.

By preventing or substantially reducing contact between the liquid cryogen and the particulates long enough (e.g. from a fraction ($10^{-3}$) of a second to a few seconds) to permit capping of the container, the invention substantially avoids these problems.

Other features and aspects of the invention will be apparent from the following description of the preferred embodiments and of the claims.

DESCRIPTION OF THE PREFERRED EMBODIMENTS

STRUCTURE

Figure 1:
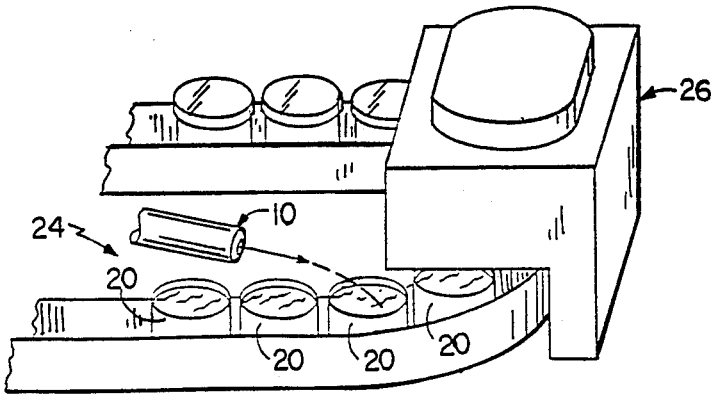
FIG. 1 is a generalized view of pressurization and capping apparatus.

In FIG. 1, a controlled liquid cryogen delivery system as described in the commonly assigned U.S. Pat. No. 4,715,187 includes a delivery nozzle 10 which provides a metered stream of liquid cryogen (e.g. liquid nitrogen) to containers 20 which have been filled with a particulate material 22 and are moving along the assembly line 24 to a capping station 26. As shown in more detail in FIGS. 2A and 2B, container 22 is filled to a certain level with particulate material 22. Suitable particulate materials include foods, drugs and industrial materials which are desirable to package in a pressurized container or an inert atmosphere, and which are in various dry forms such as granules, particles, powder and flakes. Specific examples of such material are: infant formula; powdered milk, infant dry food (cereal); powdered drinks such as instant ice tea, pharmaceuticals, and dry chemicals. Loosely packed materials, light (undense) materials, and extremely fine powders tend to be more susceptible to the eruptions which the invention controls.

Figure 2B:
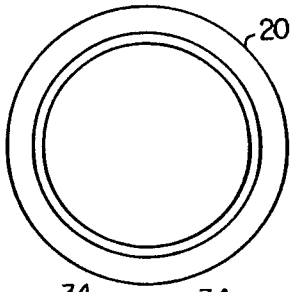
FIGS. 2A and 2B are somewhat diagrammatic cross sections of one embodiment of a liquid cryogen retainer positioned within a container of particular material.
Figure 2A:
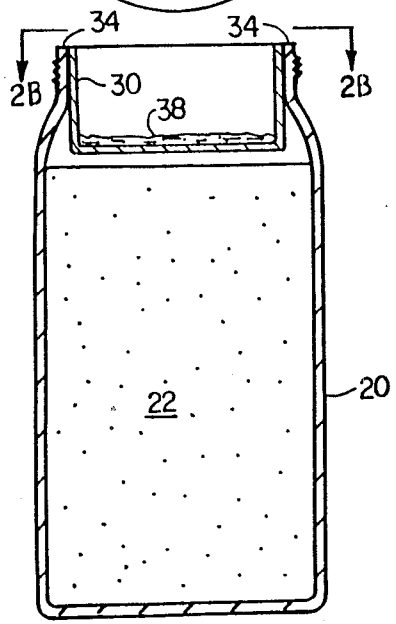

A liquid cryogen retainer 30 is positioned to span the mouth of container 22. Retainer 30 consists of a cup 32 having a lip 34 which sits on the mouth of container 22. Retainer 30 also includes vents 36 which permit vaporized liquid nitrogen to reach the remainder of container 22. As shown in FIGS. 2A and 2B, the liquid nitrogen 38 collects in retainer 30 and, before it vaporizes to the atmosphere or splashes into the granularized material, the container is capped. In any event, if some splashing occurs, any granular material which is erupted upward will be contained by the retainer. Retainer 30 can be constructed of any suitable material such as cellulosic material (e.g. cardboard) or molded plastic, using techniques well known to those in the art.

Figure 3B:
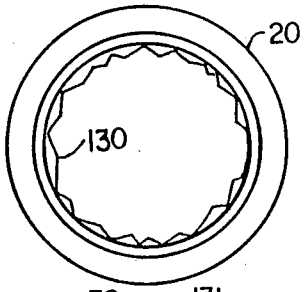
Figure 3A:
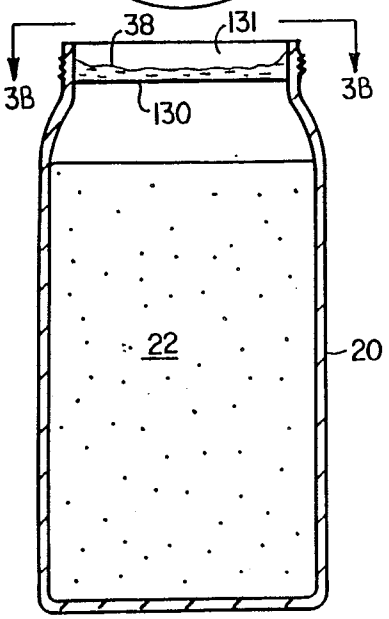

FIGS. 3A and 3B show an alternative embodiment of the retainer 130' consisting of a flexible sheet (e.g. of paper) which has been crimped around the edges to provide a small well 131' for the liquid nitrogen. The crimped sheet is designed to be maintained in position within container 22 by friction against the internal container walls, but contact against the internal walls is loose enough to permit communication of vaporization liquid nitrogen to the remainder of container 22. Retainer 130 is shown with a relatively flat lower surface, but well 131 can also be formed by irregular crimps in the flexible sheet. Also, retainer 130 need not be maintained in position above the particulate material; it can rest on the upper surface of the material.

Figure 4B:
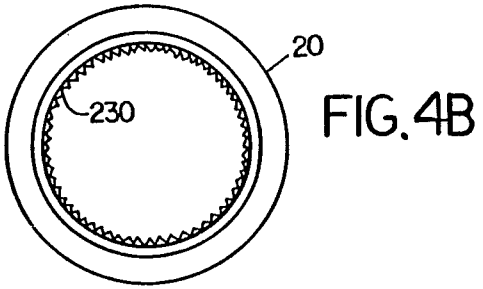
FIGS. 3A, 3B and FIGS. 4A and 4B are similar to FIGS. 2A and 2B and represent apparatus with alternative liquid cryogen retainers.
Figure 4A:
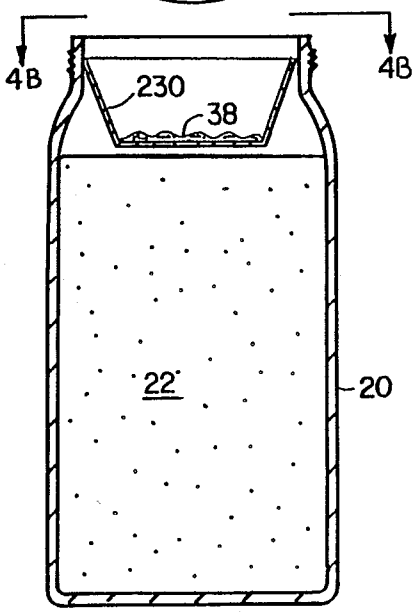

FIGS. 4A and 4B show an alternative retainer 230 consisting of a cup with pleated edges, sitting on the surface of the particulate material.

Other aspects of pressurizing sealed containers are well known to those in the art and are disclosed, for example, in the references cited above in the Background. There is no need to repeat those descriptions here.

Other embodiments are within the following claims.

We claim:

1. In a method of producing a pressurized sealed container of particulate material in which a metered flow of a desired amount of liquid cryogen is directed into an unsealed container of said particulate material immediately before the container is sealed, the improvement comprising providing a liquid cryogen retainer, positioned within said unsealed container above said particuate material, to receive said metered flow of cryogen, and directing said flow of liquid cryogen to said retainer, and capping said container, whereby eruption from said container of said particulate material, caused by penetration of said particulate material by said liquid cryogen, is substantially prevented.

2. The method of claim 1 in which said liquid cryogen retainer is a vessel.

3. The method of claim 2 in which said vessel comprises a lip engaging the top of said container.

4. The method of claim 2 or claim 3 in which said vessel substantially seals around the perimeter of said container and said vessel comprises at least one vent positioned to communicate pressure from vaporized liquid nitrogen above said vessel to the portion of the container below said vessel.

5. The method of claim 1 in which said retainer is a thin separating member whose edges are crimped to contain liquid cryogen.

* * * * *

UNITED STATES PATENT AND TRADEMARK OFFICE

CERTIFICATE OF CORRECTION

PATENT NO. : 4,947,650

DATED : August 14, 1990

INVENTOR(S) : Russell W. Blanton, J. Eric Taylor and Thornton Stearns

It is certified that error appears in the above-identified patent and that said Letters Patent is hereby corrected as shown below:

Title page, item [22], filing date should read --September 8, 1989--.

Column 3, line 44, delete "vaporization" and insert --vaporized--.

Signed and Sealed this

Nineteenth Day of January, 1993

*Attest:*

DOUGLAS B. COMER

*Attesting Officer*

*Acting Commissioner of Patents and Trademarks*